US010262852B2

(12) United States Patent
Sekimoto et al.

(10) Patent No.: US 10,262,852 B2
(45) Date of Patent: Apr. 16, 2019

(54) ATMOSPHERIC PRESSURE IONIZATION METHOD

(71) Applicants: PUBLIC UNIVERSITY CORPORATION YOKOHAMA CITY UNIVERSITY, Kanagawa (JP); AMR INCORPORATED, Tokyo (JP)

(72) Inventors: Kanako Sekimoto, Kanagawa (JP); Mitsuo Takayama, Kanagawa (JP); Hiroshi Hike, Tokyo (JP); Motoshi Sakakura, Tokyo (JP)

(73) Assignees: PUBLIC UNIVERSITY CORPORATION YOKOHAMA CITY UNIVERSITY, Kanagawa (JP); AMR INCORPORATED, Tokyo (JP)

( * ) Notice: Subject to any disclaimer, the term of this patent is extended or adjusted under 35 U.S.C. 154(b) by 0 days.

(21) Appl. No.: 15/558,389

(22) PCT Filed: Aug. 24, 2016

(86) PCT No.: PCT/JP2016/074609

§ 371 (c)(1),
(2) Date: Sep. 14, 2017

(87) PCT Pub. No.: WO2017/033959

PCT Pub. Date: Mar. 2, 2017

(65) Prior Publication Data

US 2018/0061622 A1 Mar. 1, 2018

(30) Foreign Application Priority Data

Aug. 25, 2015 (JP) ..... 2015-165952

(51) Int. Cl.
*H01J 49/14* (2006.01)
*H01J 49/16* (2006.01)

(52) U.S. Cl.
CPC ..... *H01J 49/145* (2013.01); *H01J 49/168* (2013.01)

(58) Field of Classification Search
CPC ..... H01J 49/145; H01J 49/10; H01J 49/18
(Continued)

(56) References Cited

U.S. PATENT DOCUMENTS

2016/0163527 A1 6/2016 Sekimoto et al.

FOREIGN PATENT DOCUMENTS

JP 2013-37962 2/2013
WO 2015/015641 2/2015

OTHER PUBLICATIONS

International Search Report dated Nov. 8, 2016 in International Application No. PCT/JP2016/074609.

*Primary Examiner* — Nicole M Ippolito
*Assistant Examiner* — Hanway Chang
(74) *Attorney, Agent, or Firm* — Wenderoth, Lind & Ponack, L.L.P.

(57) ABSTRACT

An atmospheric pressure ionization method uses: a gas flow passage control unit (26) and a gas outlet nozzle (24) configured to jet argon gas to an atmospheric atmosphere; a needle electrode (19) arranged between an outlet port of the gas outlet nozzle (24) and an introduction port of an ion introduction pipe (6) that includes a tip end portion formed into a two-sheeted hyperboloid of revolution having a radius of curvature of 1 μm or more and less than 30 μm; a needle electrode support mechanism (20); and an electric power generation unit (22) configured to apply a voltage to the needle electrode (19). The atmospheric pressure ionization method includes: applying a voltage of 1.8 kV or more to the needle electrode (19) from the voltage generation unit (22) to generate a dark discharge; exciting the argon gas with the
(Continued)

dark current; and causing the excited argon gas and the sample to react with each other, to thereby ionize the sample.

1 Claim, 12 Drawing Sheets

(58) Field of Classification Search
USPC ..... 250/423 R, 424, 426
See application file for complete search history.

NEEDLE ELECTRODE HAVING TIP END RADIUS OF CURVATURE OF LESS THAN 1 MICROMETER (TIP END IS FORMED INTO REVERSED CURVED SURFACE)

ATMOSPHERIC PRESSURE IONIZATION METHOD

TECHNICAL FIELD

The present invention relates to an ionization method to be used mainly in a mass spectrometer. More specifically, the present invention relates to an atmospheric pressure ionization method for ionizing a sample by applying a voltage to a needle electrode arranged in an atmospheric atmosphere to cause discharge, causing an inert gas serving as a carrier gas to flow into a discharge zone to excite the inert gas, and by causing the excited inert gas and the sample to react with each other.

BACKGROUND ART

As a procedure for ionizing a sample component in a mass spectrometer, an atmospheric pressure ionization method (ambient ionization method) for ionizing the sample component in an atmospheric atmosphere has been known. The atmospheric pressure ionization method is a technology that enables in situ mass spectrometry in real time without performing special preparation and pretreatment of a sample. Hitherto, a large number of atmospheric pressure ionization technologies using gases called a rare gas and an inert gas excited with discharge plasma have been developed.

Typical related art documents thereof include:

(1) a direct analysis in real time (DART) method (see, for example, Patent Literature 1 and Non Patent Literature 1);

(2) an atmospheric-pressure solids analysis probe (ASAP) method (see, for example, Patent Literature 2 and Non Patent Literature 2);

(3) a desorption corona beam ionization (DCBI) method (see, for example, Patent Literature 3 and Non Patent Literature 3); and (4) a flowing atmospheric pressure afterglow (FAPA) method (see, for example, Non Patent Literature 4).

In each of the DART, the DCBI, and the FAPA, a helium gas and glow discharge are combined, and in the ASAP, a nitrogen gas and corona discharge are combined.

CITATION LIST

Patent Literature

[PTL 1] WO 2009/009228 A2
[PTL 2] U.S. Pat. No. 7,977,629 B2
[PTL 3] WO 2010/075769 A1

Non Patent Literature

[NPL 1] R. B. Cody et al., "Versatile new ion source for the analysis of materials in open air under ambient conditions" (Analytical Chemistry, 77, 2297-2302 (2005))

[NPL 2] C. N. McEwen et al., "Analysis of solids, liquids, and biological tissues using solids probe introduction at atmospheric pressure on commercial LC/MS instruments," (Analytical Chemistry, 77, 7826-7831 (2005))

[NPL 3] H. Wang et al., "Desorption corona beam ionization source for mass spectrometry," (Analyst, 135, 688-695 (2010))

[NPL 4] F. J. Andrade et al., "Atmospheric pressure chemical ionization source. 1. Ionization of compounds in the gas phase," (Analytical Chemistry, 80, 2646-2653 (2008))

SUMMARY OF INVENTION

Technical Problem

As described above, in the atmospheric pressure ionization method, a helium gas is frequently used as the inert gas. This is because the energy (19.8 eV) of an excited helium gas is higher than the first ionization energies of an extremely large number of kinds of samples, and the excited helium gas can subject any sample to molecule ionization, protonation, and/or deprotonation.

In the mass spectrometry, in order to easily identify a sample substance, there is a demand for the acquisition of a simple mass spectrum in which only a protonated molecule and/or a deprotonated molecule of the sample is detected. This also applies to the case using the atmospheric pressure ionization method.

However, the ionization using an excited helium gas has the following problem. The energy of the excited helium gas is as high as 19.8 eV. Therefore, for example, when a protonated molecule generation reaction and/or a deprotonated molecule generation reaction of the sample using a penning ionization reaction (12.6 eV) of a water molecule as a starting point is effected, oxygen adduct ions, dehydrogenated ions, and the like are generated as by-products by the excess energy accumulated in the sample, in addition to the protonated molecule and/or the deprotonated molecule. As a result, a mass spectrum cannot be analyzed in a rational manner, and it is very difficult to identify the sample substance.

Further, the ionization using a helium gas has the following problem. The helium gas is light owing to the small atomic weight thereof, and hence it is necessary to take the load on a mass spectrometer into consideration. That is, in a general mass spectrometer, the flow of the excess gas leads to the decrease in vacuum degree of the mass spectrometer and the reduction in device life duration. Therefore, a plurality of turbo-molecular pumps are mounted, and a vacuum is created by flicking off a gas molecule through the rotation of vanes. However, when the helium gas is used, the helium gas is light owing to the small atomic weight (mass: 4) thereof and hence sneaks through the vanes, resulting in a situation in which the vacuum degree is decreased. When the vacuum degree is decreased, there is a risk in that the turbo-molecular pumps are damaged, which leads to the reduction in life duration of the mass spectrometer. Therefore, when the helium gas is used, it is necessary to separately prepare a special vacuum pumping system dedicated to the helium gas, which enables the helium gas to be eliminated. The preparation is largely responsible for an increase in cost of the mass spectrometer.

Further, there is the following problem. The helium gas is light, and hence the helium gas blown out from an outlet port is liable to diffuse. Therefore, in a mass spectrometer in which an ion source using the helium gas is mounted, it is preferred that the distance between an outlet nozzle of the helium gas, a needle electrode for glow discharge or corona discharge, and an ion introduction pipe be short. However, the mass spectrometer is configured so that a sample may be arranged on a primary side of the needle electrode in order to effectively suck an ionized sample from the ion introduction pipe. Therefore, such mass spectrometer is not suitable for mass spectrometry of a large sample.

Further, there is the following problem. The helium gas is difficult to obtain and is expensive, which leads to an increase in cost of mass spectrometry and makes it difficult to use the helium gas sustainably. Therefore, the helium gas is not suitable for the atmospheric pressure ionization method.

Further, when a nitrogen gas is used as the inert gas, there is the following problem. The nitrogen gas is a diatomic molecule, and there are a large number of kinds of excitation bands thereof. Therefore, an ionization reaction involving various minor reactions occurs. In particular, when the molecular weight of an unknown compound is measured, it cannot be determined which peak of ion peaks corresponds to a protonated molecule and/or a deprotonated molecule. As a result, a mass spectrum cannot be analyzed in a rational manner, and it is very difficult to identify the sample substance.

Further, the existing atmospheric pressure ionization methods using discharge have the following problem. All the existing atmospheric pressure ionization methods use continuous discharge involving an emission phenomenon. In order to cause continuous discharge to occur, a high voltage is required. For example, a DART method requires a voltage of 5 kV, a DCBI method requires a voltage of 3 kV (from 10 μA to 40 μA), a FAPA method requires a voltage of 25 mA (500 V), and an ASAP method requires a voltage (about 3 kV) used in a general atmospheric pressure chemical ionization (APCI) method. Thus, ion sources requiring a high voltage may be unusable depending on the in-situ voltage situation. Accordingly, there is a demand for the development of an ion source that can be used in any circumstance and can be operated at a lower voltage.

The inventors of the present invention have repeatedly performed experiment and research so as to solve the above-mentioned problems.

First, the inventors of the present invention have focused attention on the use of an argon gas, which has an atomic weight (mass: 40) 10 times as large as that of a helium gas and which can be obtained much more easily at lower cost than the helium gas is, as an inert gas. As the argon gas, an excited argon gas having a life duration of $10^{-5}$ s or more and a stable energy of 15.6 eV has been known in addition to excited argon gases (excited species) having stable energies of 11.5 eV and 11.8 eV.

Hitherto, generation technologies for the excited argon gases having energies of 11.5 eV and 11.8 eV have been established (liquid ionization mass spectrometry (LI-MS)), and have been used for generating a molecular ion of a sample.

However, the penning ionization of a water molecule requires an energy of 12.6 eV. Therefore, the excited argon gases having excitation energies of 11.5 eV and 11.8 eV cannot cause the penning ionization of a water molecule to occur and cannot generate a protonated molecule and/or a deprotonated molecule of a sample.

When the excited argon gas has an energy of 15.6 eV, the energy is more than the energy of 12.6 eV for the penning ionization of a water molecule. Further, the excited argon gas having an energy of 15.6 eV has a life duration of $10^{-5}$ s or more. Therefore, it is considered that such excited argon gas can cause the penning ionization reaction of a water molecule to occur sufficiently.

Further, when the excited argon gas has an energy of 15.6 eV, the energy of 15.6 eV is lower than the energy (19.8 eV) of the excited helium gas. Therefore, when a protonated molecule generation reaction or/and a deprotonated molecule generation reaction of the sample using the penning ionization reaction of a water molecule as a starting point is effected, it is considered that the excess energy accumulated in the sample is small, and by-product generation reactions of oxygen adduct ions, dehydrogenated ions, and the like are less liable to occur. That is, the efficiency of the protonated molecule generation reaction or/and the deprotonated molecule generation reaction of the sample increases, and the ion intensity of the protonated molecule or/and the deprotonated molecule of the sample is high. Thus, a mass spectrum that allows those molecules to be easily identified is obtained.

As an attempt to generate the excited argon gas having an energy of 15.6 eV, an argon gas was caused to flow in the above-mentioned DART or ASAP. As a result, it was found that the entire ion intensity including the protonated molecule or/and the deprotonated molecule was significantly decreased, and the excited argon gas having an energy of 15.6 eV could not be generated. Further, it was found that it was difficult to generate the excited argon gas having an energy of 15.6 eV even by the other existing ionization methods.

In view of the foregoing, the inventors of the present invention have repeatedly performed experiment and research so as to generate the excited argon gas having an energy of 15.6 eV. As a result, the inventors of the present invention have found that protonated molecules or/and deprotonated molecules of a large number of kinds of samples are continuously generated in an ion amount detected sufficiently with a mass spectrometer by: using a needle electrode that includes a tip end portion formed into a two-sheeted hyperboloid of revolution, disclosed in JP 2013-37962 A filed previously by the inventors of the present invention; and causing non-continuous discharge not involving an emission phenomenon in the needle electrode, that is, applying a dark discharge voltage (extremely low voltage compared to voltage required for continuous discharge that has been hitherto used) to the needle electrode to cause discharge.

In this case, ions generated as by-products other than the above-mentioned protonated molecule or/and deprotonated molecule of the sample were not detected, or the intensities thereof were very small. That is, this means that the excited argon gas having an energy of 15.6 eV is efficiently generated under the above-mentioned discharge condition (the protonated molecule or/and the deprotonated molecule of the sample can be continuously generated in an ion amount detected sufficiently with a mass spectrometer). With this, the inventors of the present invention have achieved the present invention.

It is an object of the present invention is to provide an atmospheric pressure ionization method that enables the protonated molecule generation reaction or/and the deprotonated molecule generation reaction of a sample using the penning ionization reaction of a water molecule as a starting point without involving a minor ion reaction through use of an excited argon gas generated with a dark discharge current when ionizing the sample with a mass spectrometer.

It is another object of the present invention to provide an atmospheric pressure ionization method that enables a sample to be ionized easily with a low voltage at low cost.

Solution to Problem

In order to achieve the above-mentioned objects, according to one embodiment of the present invention, there is provided an atmospheric pressure ionization method for ionizing a sample by applying a voltage to a needle electrode to cause discharge, causing an inert gas to flow into a discharge zone to excite the inert gas, and causing the excited inert gas and the sample to react with each other, the atmospheric pressure ionization method using an argon gas as the inert gas and using: a gas flow passage control unit and a gas outlet nozzle configured to jet the argon gas to an atmospheric atmosphere at a predetermined flow rate and a predetermined temperature; a needle electrode that is arranged between an outlet port of the gas outlet nozzle and an introduction port of an ion introduction pipe configured to introduce an ion, and that includes a tip end portion formed into a two-sheeted hyperboloid of revolution having a radius of curvature of 1 μm or more and less than 30 μm; a needle electrode support mechanism configured to adjust a relative position and/or a relative angle of the needle electrode with respect to a center axis of the gas outlet nozzle; and a voltage generation unit configured to apply a voltage to the needle electrode, the atmospheric pressure ionization method including:

applying a voltage of 1.8 kV or more to the needle electrode from the voltage generation unit to generate a dark discharge;

exciting the argon gas with a dark discharge current; and causing the excited argon gas and the sample to react with each other, to thereby ionize the sample.

According to the present invention, when a voltage is applied to the needle electrode that includes the tip end portion formed into a two-sheeted hyperboloid of revolution having a radius of curvature of 1 μm or more and less than 30 μm, electric field intensities that are different depending on the curvatures of different positions (non-uniform electric field) occur at the different positions on the tip end portion of the needle electrode, and an electric field having an extremely high intensity is generated in a "region within a certain range", such as the most tip end of the needle electrode and the peripheral surface thereof.

Merely through the application of a voltage of 1.8 kV or more to the needle electrode to generate a dark discharge, electrons in "some amount" accelerated and/or released continuously at the most tip end of the needle electrode and the peripheral surface thereof are each allowed to have an energy of 15.6 eV or more.

That is, in the present invention, the tip end portion of the needle electrode is formed into a two-sheeted hyperboloid of revolution having a radius of curvature of 1 μm or more and less than 30 μm, and hence through application of a voltage of 1.8 kV or more to the needle electrode to generate a dark discharge, an electric field having an extremely high intensity is generated in the "region within a certain range", such as the most tip end of the needle electrode and the peripheral surface thereof. Therefore, the protonated molecule generation reaction or/and the deprotonated molecule generation reaction of the sample using the penning ionization reaction (12.6 eV) of a water molecule as a starting point as described later is continuously effected from the "region within a certain range", and electrons each having an energy of 15.6 eV or more can be released in an amount capable of continuously generating the excited argon gas required for obtaining the ion amount that can be detected with a mass spectrometer.

The intensity of the electric field generated from the tip end portion of the needle electrode depends on the distance between an opposing electrode and the needle electrode, the direction (angle) of the tip end portion of the needle electrode with respect to the opposing electrode, and the voltage applied to the needle electrode.

That is, as the distance between the opposing electrode and the needle electrode is shorter, as the direction of the tip end portion of the needle electrode is set so that the distance of electric field line generated from the tip end portion of the needle electrode to the opposing electrode may become shorter, and as the applied voltage is higher, the electric field intensity increases.

The object of the present invention is to provide the atmospheric pressure ionization method that can be carried out with "low electric power". In order to create a dark discharge in which the excited argon gas can be generated with lower electric power, it is preferred that the distance between the opposing electrode and the needle electrode be shortened, and the direction of the tip end portion of the needle electrode with respect to the opposing electrode be set so that the distance of electric field line generated from the tip end portion of the needle electrode to the opposing electrode may become shorter.

When an argon gas is caused to flow into a discharge zone in which electrons each having an energy of 15.6 eV or more discharged from the tip end portion of the needle electrode as described above are present, the argon gas collides and reacts with the electrons, to thereby gain an energy of 15.6 eV. As a result, an excited argon gas is continuously generated in an amount required for obtaining an ion amount that can be detected with the mass spectrometer.

In order to cause the reaction between the electrons each having an energy of 15.6 eV or more and the argon gas to occur efficiently, and to generate the excited argon gas having an energy of 15.6 eV in a larger amount, it is preferred that the electrons each having an energy of 15.6 eV or more be generated in a large amount, and in addition, the amount of the argon gas involved in the reaction be larger. Further, it is preferred that the opposing electrode with respect to the needle electrode be extremely close to the outlet port of the gas outlet nozzle configured to blow out the argon gas. The reason for this is as described below. The argon gas that is neutral is not influenced by the electric field and diffuses into the atmosphere after being blown out from the outlet port of the gas outlet nozzle. Therefore, the density of the argon gas is highest in the vicinity of the outlet port. When the opposing electrode is installed in the vicinity of the outlet port, the electrons each having an energy of 15.6 eV or more generated in the dark discharge and the argon gas react with each other significantly efficiently, and the excited argon gas having an energy of 15.6 eV can be generated in a larger amount.

When the excited argon gas thus generated and the sample are caused to react with each other, the by-product generation reaction in which an ionization reaction occurs with an energy of 15.6 eV or more is suppressed, and only the protonated molecule generation reaction or/and the deprotonated molecule generation reaction of the sample using the penning ionization reaction (12.6 eV) of a water molecule as a starting point occurs. Thus, ions derived from the sample generated in the protonated molecule generation reaction or/and the deprotonated molecule generation reaction (protonated molecule or/and deprotonated molecule of the sample) can be effectively taken out. With this, a mass spectrum can be analyzed in a rational manner, and the sample substance can be easily identified.

Further, the excited argon gas having an energy of 15.6 eV, which is neutral, diffuses into the atmosphere without being influenced by the electric field. However, the straightness of the argon gas is high because the argon gas is heavy because of a large mass thereof. Therefore, even when the distance between the outlet port of the gas outlet nozzle configured to blow out the argon gas, the needle electrode, and the introduction port of the ion introduction pipe configured to introduce ions is set to be long, the argon gas blown out from the outlet port of the gas outlet nozzle reaches the introduction port of the ion introduction pipe while hardly diffusing.

Advantageous Effects of Invention

In the atmospheric pressure ionization method according to the present invention, the excited argon gas having an energy of 15.6 eV can be generated by applying, to the needle electrode that includes the tip end portion formed into a two-sheeted hyperboloid of revolution having a radius of curvature of 1 μm or more and less than 30 μm, a voltage of 1.8 kV or more to generate a dark discharge and causing the argon gas to flow into the discharge zone to excite the argon gas. When the excited argon gas thus generated and the sample are caused to react with each other, ions derived from the sample generated in the protonated molecule generation reaction or/and the deprotonated molecule generation reaction (protonated molecule or/and deprotonated molecule of the sample) can be effectively taken out by the protonated molecule generation reaction or/and the deprotonated molecule generation reaction of the sample using the penning ionization reaction of a water molecule as a starting point without involving a minor ion reaction. With this, a mass spectrum can be analyzed in a rational manner, and the sample substance can be easily identified.

Further, the argon gas is heavier than a helium gas because of the atomic weight (mass: 40) 10 times as large as that of the helium gas. Therefore, the argon gas can be easily eliminated with turbo-molecular pumps installed in a general mass spectrometer, and the decrease in vacuum degree of the mass spectrometer can be prevented. Further, it is not necessary to separately prepare a special vacuum pumping system for eliminating the helium gas, and hence the increase in cost of the mass spectrometer can be suppressed.

Further, the excited argon gas having an energy of 15.6 eV, which is neutral, diffuses into the atmosphere without being influenced by the electric field. However, the straightness of the argon gas is high because the argon gas is heavy because of a large mass thereof. Therefore, even when the distance between the outlet port of the gas outlet nozzle configured to blow out the argon gas, the needle electrode, and the introduction port of the ion introduction pipe configured to introduce ions is set to be long, the argon gas blown out from the outlet port of the gas outlet nozzle reaches the introduction port of the ion introduction pipe while hardly diffusing. Thus, when a secondary side of the needle electrode is defined as a sample arrangement position (sample ion reaction region), the distance between the needle electrode and the introduction port of the ion introduction pipe can be set to be long, and a sample that is much larger than that in a mass spectrometer having an ion source using the helium gas mounted thereon can be analyzed.

Further, the argon gas can be obtained at lower cost than the helium gas is, and hence the cost of the mass spectrometry can be reduced.

Further, in the present invention, a voltage of 1.8 kV or more is applied to the needle electrode to generate a dark discharge, and the argon gas is excited with a dark discharge current. The intensity of an electric field generated from the needle electrode is low. Therefore, the tip end portion of the needle electrode is not deformed with the passage of time, the deformation being observed in the case where a high electric field intensity leading to continuous discharge, such as corona discharge, occurs, and the excited argon gas having an energy of 15.6 eV can be generated for a long time period in a stable state.

DESCRIPTION OF EMBODIMENTS

Now, an example of an atmospheric pressure ionization method according to an embodiment of the present invention is described in detail.

An atmospheric pressure ionization method of this example is an atmospheric pressure ionization method for ionizing a sample by applying a voltage to a needle electrode to cause discharge, causing an inert gas to flow into a discharge zone to excite the inert gas, and causing the excited inert gas and the sample to react with each other. In the present invention, an argon gas is used as the inert gas. In addition, the atmospheric pressure ionization method uses: a gas flow passage control unit and a gas outlet nozzle configured to jet the argon gas to an atmospheric atmosphere at a predetermined flow rate and a predetermined temperature; a needle electrode that is arranged between an outlet port of the gas outlet nozzle and an introduction port of an ion introduction pipe configured to introduce an ion, and that includes a tip end portion formed into a two-sheeted hyperboloid of revolution; a needle electrode support mechanism configured to adjust a relative position and/or a relative angle of the needle electrode with respect to a center axis of the gas outlet nozzle; and a voltage generation unit configured to apply a voltage of 1.8 kV or more to the needle electrode. The atmospheric pressure ionization method includes: applying a voltage of 1.8 kV or more to the needle electrode from the voltage generation unit to generate a dark discharge; exciting the argon gas with a dark discharge current; and causing the excited argon gas and the sample to react with each other, to thereby ionize the sample.

Figure 1:
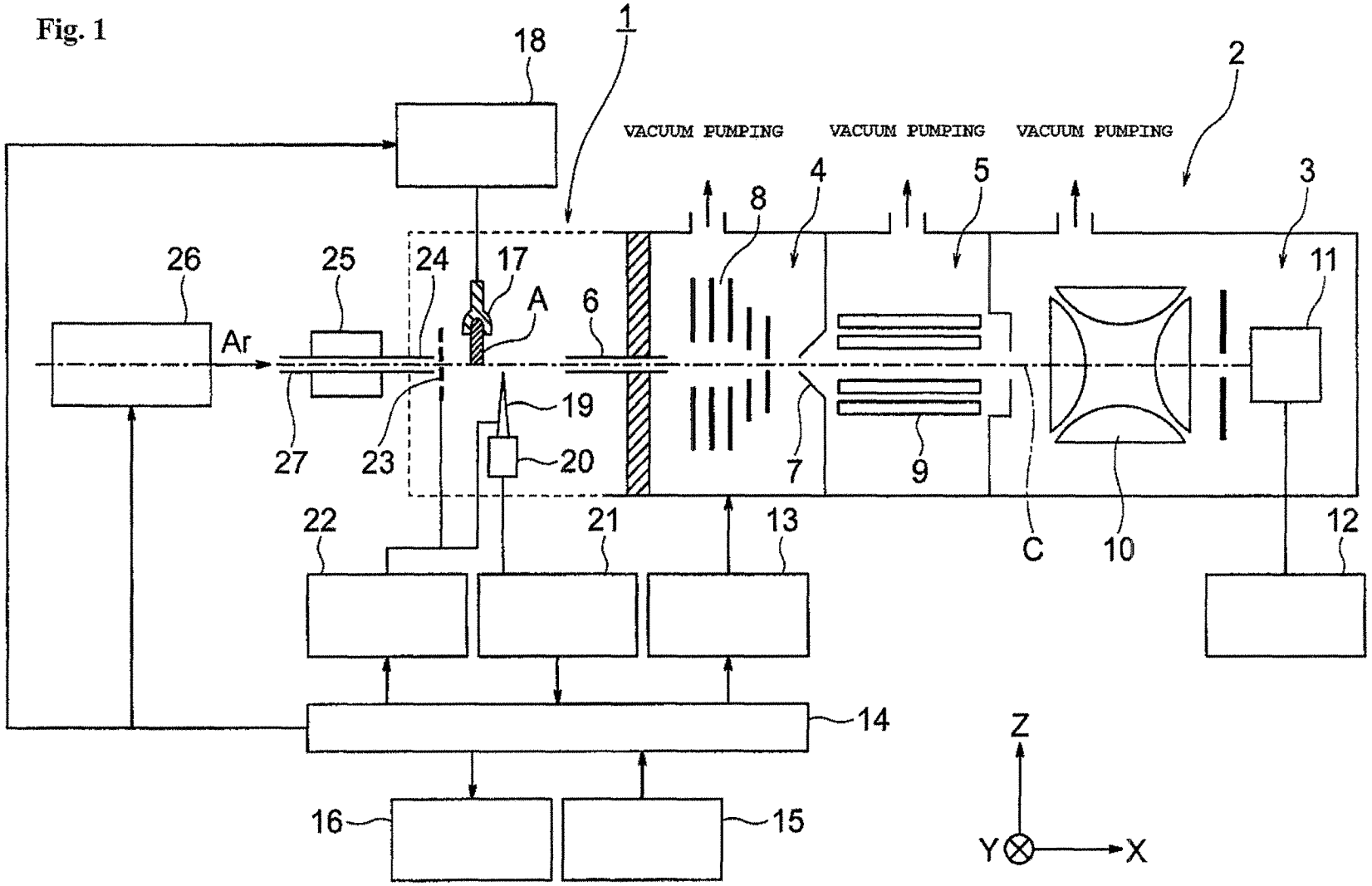
FIG. 1 is a schematic configuration view for illustrating an example of a mass spectrometer including an ionization apparatus to be used for carrying out an atmospheric pressure ionization method according to the present invention.

FIG. 1 is a view for illustrating an example of a mass spectrometer including an ionization apparatus to be used for carrying out the present invention, and the atmospheric pressure ionization method according to the present invention is described by way of Example with reference to FIG. 1.

First, a mass spectrometer 2 including an ionization apparatus 1 to be used for carrying out the present invention is described.

The mass spectrometer 2 has a configuration of a multistage differential pumping system including a first intermediate vacuum chamber 4 and a second intermediate vacuum chamber 5 in each of which a vacuum degree is increased in stages between the ionization apparatus 1 arranged in an atmospheric atmosphere and an analysis chamber 3 in a high vacuum atmosphere that is subjected to vacuum pumping with a high-performance vacuum pump (not shown). The ionization apparatus 1 and the first intermediate vacuum chamber 4 in the subsequent stage communicate to each other through a thin ion introduction pipe 6.

The first intermediate vacuum chamber 4 and the second intermediate vacuum chamber 5 are partitioned with a skimmer 7 having a small hole at the top thereof, and ion guides 8 and 9 configured to transport ions into a later stage while converging the ions are arranged in the first intermediate vacuum chamber 4 and the second intermediate vacuum chamber 5, respectively. In this example, the ion guide 8 has a configuration in which a plurality of electrode plates arranged along an ion optical axis C serve as one imaginary rod electrode, and a plurality of (for example, four) imaginary rod electrodes are arranged around the ion optical axis C. Further, the ion guide 9 has a configuration in which a plurality of (for example, eight) rod electrodes extending in a direction along the ion optical axis C are arranged around the ion optical axis C. However, the ion guides 8 and 9 are not limited to the above-mentioned configurations and may be modified appropriately.

Further, a mass separation unit 10 configured to separate the ions in accordance with a mass-to-charge ratio m/z and an ion detector 11 configured to detect the ions having passed through the mass separation unit 10 are arranged in the analysis chamber 3. Any kind of mass separation unit, e.g., a quadrupole mass filter, an ion trap, a time-of-flight measurement type drift tube, a Fourier transform type cyclotron or an orbitrap, an electric field, or a magnetic field, may be used as the mass separation unit 10. A detection signal from the ion detector 11 is sent to a data processing unit 12.

A power source unit 13 is configured to apply a predetermined voltage to each of, for example, the ion guides 8 and 9, and the mass separation unit 10 under the control of an analysis control unit 14. The analysis control unit 14 is connected to an input unit 15 and a display unit 16 operated by a user (analyst). In general, the analysis control unit 14 and the data processing unit 12 are configured to achieve each function by using a personal computer as a hardware resource and executing dedicated control and processing software previously installed in the computer.

Further, in the ionization apparatus 1, a sample holder 17 configured to hold a sample A to be analyzed, a sample drive mechanism 18 configured to drive the sample holder 17, a needle electrode 19, a needle electrode support mechanism 20 configured to adjust the relative position and/or the relative angle of the needle electrode 19 with respect to a center axis of a gas outlet nozzle described later, a needle electrode position drive unit 21, a voltage generation unit 22 configured to apply a voltage of 1.8 kV or more to the needle electrode 19, an opposing electrode 23, a gas outlet nozzle 24, a gas heating mechanism 25, and a gas flow passage control unit 26 are arranged.

The gas heating mechanism 25 is connected to a gas introduction pipe 27 configured to introduce an argon gas. The gas flow passage control unit 26 is configured to introduce an argon gas having a controlled flow rate into the gas heating mechanism 25 under the control of the analysis control unit 14. The opposing electrode 23 is installed at an outlet port of the gas outlet nozzle 24 or in the vicinity of the outlet port (hereinafter simply referred to as "outlet port"). The opposing electrode 23 has a ring shape or a grid shape and serves to allow a gas to pass therethrough.

The sample holder 17 may be installed between the outlet port of the gas outlet nozzle 24 and the needle electrode 19 or between the needle electrode 19 and an introduction port of the ion introduction pipe 6.

In this example, the sample holder 17 is installed between the outlet port of the gas outlet nozzle 24 and the needle electrode 19.

Figure 2:
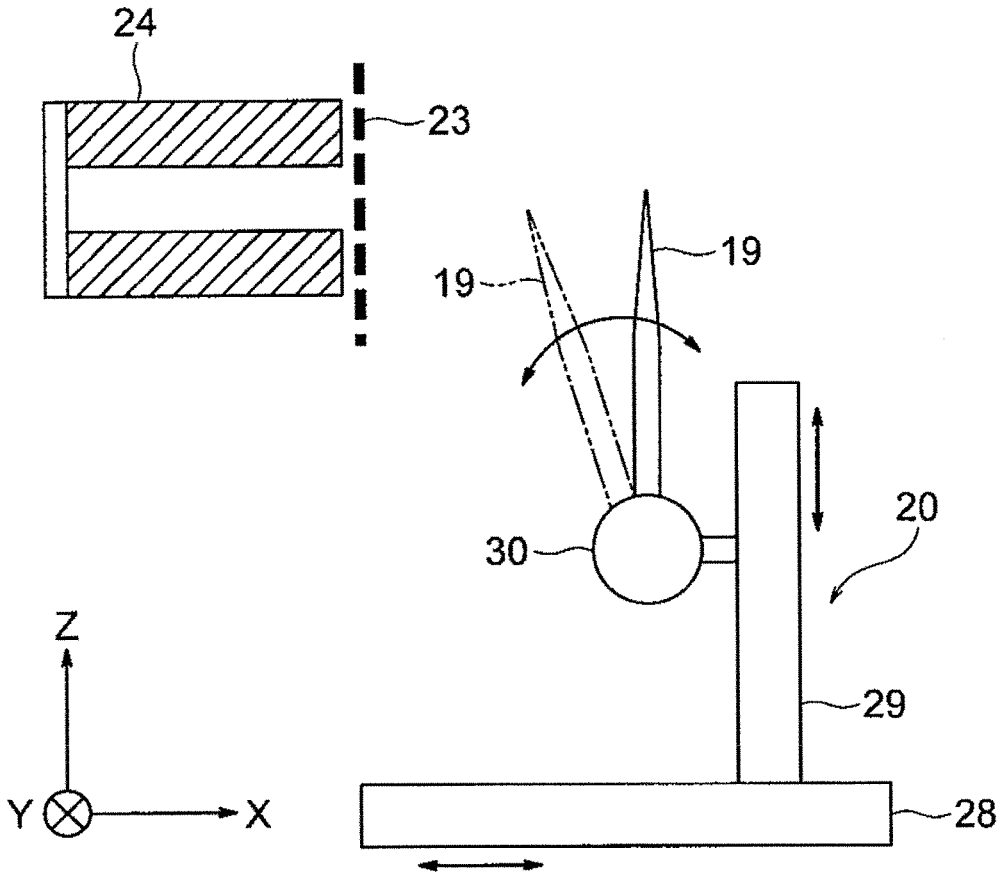
FIG. 2 is an enlarged schematic configuration view for illustrating an opposing electrode and a needle electrode support mechanism installed at an outlet port of a gas outlet nozzle illustrated in FIG. 1.

FIG. 2 is a schematic view of the needle electrode support mechanism 20 installed between the opposing electrode 23 installed at the outlet port of the gas outlet nozzle 24 and the introduction port of the ion introduction pipe 6.

The needle electrode support mechanism 20 includes an X-Y axis drive mechanism 28 capable of moving the needle electrode 19 in two directions, i.e., an X-axis direction and a Y-axis direction of the figure, a Z-axis drive mechanism 29 capable of moving the needle electrode 19 in a Z-axis direction, and a tilting mechanism 30 capable of tilting the needle electrode 19 at a predetermined angle in the whole circumference with the Z-axis direction being the center. In this example, a gas jetting direction from the gas outlet nozzle 24 and an ion suction direction of the ion introduction pipe 6 are both defined as the X-axis direction.

The X-Y axis drive mechanism 28, the Z-axis drive mechanism 29, and the tilting mechanism 30 each include a motor or an actuator other than the motor, and are each driven with a drive signal supplied from the needle electrode position drive unit 21. With this, the relative position and relative angle of the needle electrode 19 with respect to the ion introduction pipe 6 can each be set freely within a predetermined range. However, the position and tilt angle of the needle electrode 19 may be adjusted manually instead of using a drive source, such as a motor.

Figure 3:
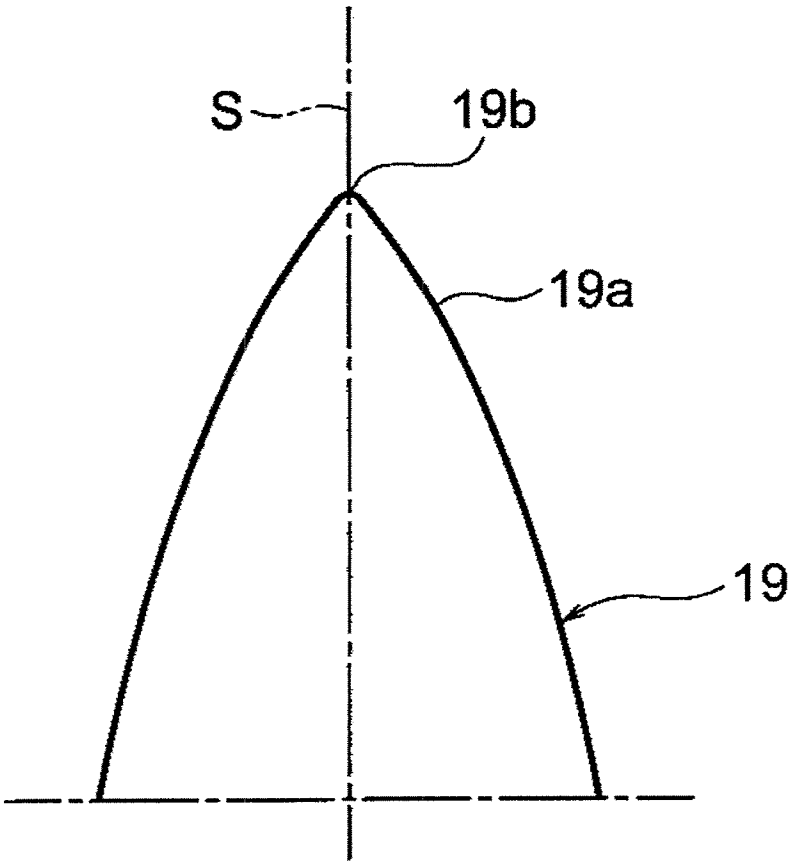
FIG. 3 is an enlarged view for illustrating a tip end portion of the needle electrode.

FIG. 3 is an enlarged view for illustrating the tip end portion of the needle electrode 19. A tip end portion 19*a* of the needle electrode 19 is approximated to a hyperboloid, a paraboloid, or an ellipsoid that is rotationally symmetric around a center axis S, and is formed into a curved surface shape so that the most tip end thereof may have a radius of curvature of from 1 μm to 30 μm.

When a voltage of 1.8 kV or more is applied to the needle electrode 19 having such tip end curvature to generate a dark discharge, electric field intensities that are different depending on the curvatures of different positions (non-uniform electric field) occur at the different positions on the tip end portion 19*a* of the needle electrode 19, and an electric field having an extremely high intensity is generated in a "region within a certain range", such as the most tip end of the needle electrode 19 and the peripheral surface thereof.

Thus, merely through the application of a voltage of 1.8 kV or more to the needle electrode 19 to generate a dark discharge, electrons in "some amount" accelerated and/or released continuously at the tip end portion 19*a* of the needle electrode 19, that is, at the most tip end 19*b* and the peripheral surface thereof are each allowed to have an energy of 15.6 eV or more required for achieving the object of the present invention.

That is, the surface of the needle electrode 19 is an equipotential surface, but the curvature of the tip end portion 19*a* of the needle electrode 19 varies from position to position. Therefore, the intensities of electric fields generated at respective positions are different. On the surface of the needle electrode 19, the curvature of the most tip end 19*b* is largest (=radius of curvature is smallest), and the curvature decreases with increasing distance from the most tip end 19*b*. That is, the intensity of an electric field generated with a certain voltage is highest at the most tip end 19*b* and decreases with increasing distance from the most tip end 19*b*.

Meanwhile, the intensity of an electric field generated on the entire surface of the needle electrode 19 depends on the distance between the opposing electrode 23 and the needle electrode 19, the direction of the tip end portion 19*a* of the needle electrode 19 with respect to the opposing electrode 23, and the voltage applied to the needle electrode 19. When the intensity of the electric field generated on the entire surface of the needle electrode 19 increases, the intensity of an electric field generated in the tip end portion 19*a* (most tip end 19*b* and the periphery thereof) of the needle electrode 19 increases as a whole. This means that the region in which electrons each having a kinetic energy of 15.6 eV or more can be generated is enlarged, and as a result, the electrons each having a kinetic energy of 15.6 eV or more can be generated in a larger amount.

Figure 4:
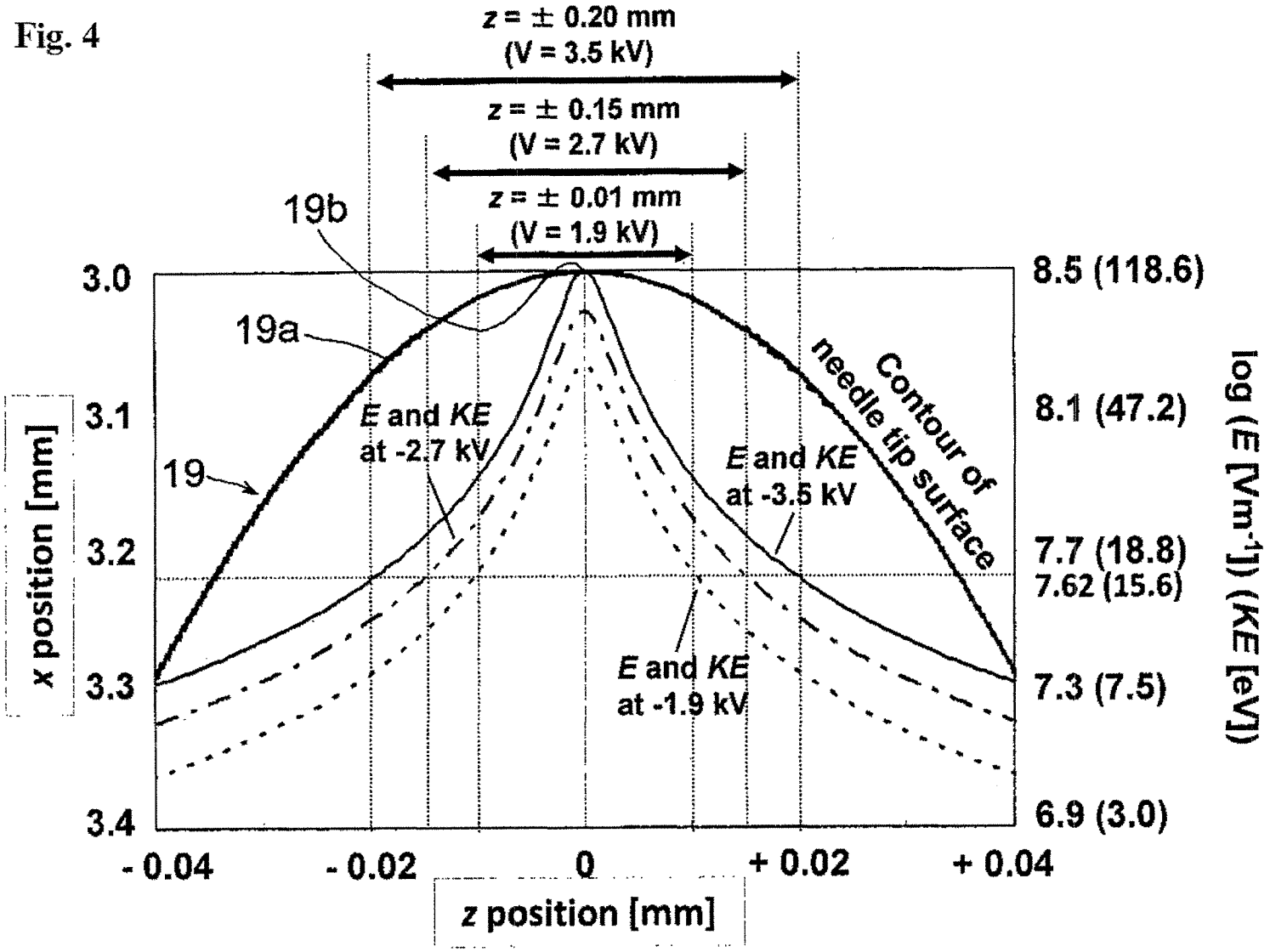
FIG. 4 is an explanatory diagram for showing the spread of a region in which electrons each having a kinetic energy of 15.6 eV or more can be generated when a voltage applied to the needle electrode is increased to 1.9 kV, 2.7 kV, and 3.5 kV.

For example, as illustrated in FIG. 4, in the case where the tip end curvature of the needle electrode 19 is 1 μm, the distance between the needle electrode 19 and the opposing electrode 23 is 3 mm, and the direction of the tip end portion 19*a* of the needle electrode 19 with respect to the opposing electrode 23 is 0° (=the center axis S of the needle electrode is perpendicular to the opposing electrode 23), when the voltage applied to the needle electrode 19 is increased to 1.9 kV, 2.7 kV, and 3.5 kV, a region in which electrons each having a kinetic energy of 15.6 eV or more can be generated spreads from the most tip end 19*b* of the needle electrode 19 by 0.01 mm, 0.015 mm, and 0.02 mm, respectively in the Y-axis direction and the Z-axis direction.

A kinetic energy $KE_i$ [eV] that can be carried by each of electrons is estimated on the basis of a product of an electric field intensity $E_i$ [$Vm^{-1}$] of a surface position i of the needle electrode 19 at which the electrons are accelerated and/or released and a mean free path λ [m] of the electrons in the atmosphere ($66.3\times10^{9}$ [m] under the atmospheric pressure). Thus, $KE_i=E_i\times\lambda$ is satisfied.

$KE_i=E_i\times\lambda$, and the needle tip end curvature, interelectrode distance, direction, and voltage dependences on a non-uniform electric field generated at the tip end of the needle electrode 19 are described in the thesis of the inventors of the present invention (K. Sekimoto et al., Eur. Phys. J. D, vol. 60, pp. 589-599, 2010).

When a voltage is applied to the needle electrode 19, the voltage generation unit 22 applies a direct (positive or negative) voltage or alternating voltage in a dark-discharge current range to the needle electrode 19 in accordance with the instruction from the analysis control unit 14. Therefore, light emission is not observed in any portion other than the tip end portion 19*a* of the needle electrode 19. The opposing electrode 23 is, for example, grounded to be fixed to 0 V or set to a predetermined potential applied from the voltage generation unit 22 (which is not a potential applied to the needle electrode 19). Therefore, an electric field is formed between the tip end portion 19*a* of the needle electrode 19 having a voltage applied thereto and the opposing electrode 23.

The ionization apparatus 1 including the above-mentioned respective mechanisms is configured to ionize various components contained in the sample A arranged at the sample holder 17 in accordance with the following operation principle. That is, an argon gas having a flow rate controlled by the gas flow passage control unit 26 is introduced into the gas heating mechanism 25 through the gas introduction pipe 27, and the heated argon gas is jetted from the outlet port of the gas outlet nozzle 24.

When a voltage of 1.8 kV or more is applied to the needle electrode 19 from the voltage generation unit 22 in this state to generate a dark discharge, electrons each having an energy of 15.6 eV or more are generated in a "certain amount" in a "certain region (most tip end 19*b* and the periphery thereof)" of the tip end portion 19*a* of the needle electrode 19 having an electric field intensity capable of generating the electrons each having an energy of 15.6 eV or more. Those electrons collide and react with the argon gas to generate a "certain amount" of an excited argon gas having an energy of 15.6 eV through a reaction formula of R1.

$$Ar+e_{fast}^{-}(>15.6\ eV)\rightarrow Ar^{*}(15.6\ eV)+e_{slow}^{-} \quad (R1)$$

Then, the excited argon gas (Ar*) having an energy of 15.6 eV subjects a water molecule in the atmosphere present in the ionization apparatus 1 to penning ionization (R2). Water molecule ions $H_2O^+$ thus generated further react with a water molecule in the atmosphere to generate oxonium ions $H_3O^+$ (R3). Meanwhile, low-speed electrons $e_{slow}^{-}$ generated in R2 adhere to oxygen in the atmosphere to generate superoxide anions $O_2^{-}$ (R4). Note: Ar*=excited argon gas $$H_2O+Ar^{*}\rightarrow H_2O^{+}+e_{slow}^{-}+Ar \quad (R2)$$

$$H_2O^+ + H_2O \rightarrow H_3O^+ + OH \quad (R3)$$

$$O_2 + e_{slow}^- + P \rightarrow O_2^- + P \text{ (P: third body, such as } N_2, O_2, \text{ or Ar)} \quad (R4)$$

Further, the gas containing the excited argon gas having an energy of 15.6 eV is heated by the gas heating mechanism 25 to have a high temperature. Therefore, when the gas is sprayed onto the sample A, a component molecule in the sample A is vaporized. When the oxonium ions $H_3O^+$ generated in the R3 and the superoxide anions $O_2^-$ generated in the R4 act on a component molecule M generated by the vaporization, a proton transfer reaction occurs, and a protonated molecule $[M+H]^+$ and/or a deprotonated molecule $[M-H]^-$ of the component molecule are generated (R5, R6).

$$M + H_3P^+ \rightarrow [M+H]^+ + H_2O \quad (R5)$$

$$M + O_2^- \rightarrow [M-H]^- + HO_2 \quad (R6)$$

Here, the energy of 15.6 eV of the excited argon gas is lower than the energies of the other inert gases (for example, the excited helium gas has an energy of 19.8 eV). Therefore, the amount of the excess energy accumulated in the sample A during the reactions R2 and R6 is small, and by-products, such as oxygen adduct ions and deprotonated ions, other than the protonated molecule $[M+H]^+$ and/or the deprotonated molecule $[M-H]^-$ are hardly generated.

In order to detect the protonated molecule $[M+H]^+$ and/or the deprotonated molecule $[M-H]^-$ of the component molecule in the sample generated in the R5 and R6 with good sensitivity with the mass spectrometer and to obtain a meaningful mass spectrum (mass spectrum in which a S/N ratio with respect to the peak of ions of the protonated molecule or the deprotonated molecule of the sample is three times or more), it is necessary that the $[M+H]^+$ and/or the $[M-H]^-$ be "continuously" generated in "some amount of a detection limit or more" that can be detected with the mass spectrometer. For this purpose, considerable amounts of $H_3O^+$ and $O_2^-$ for generating the $[M+H]^+$ and/or the $[M-H]^-$ are required, that is, it is necessary that the penning ionization of a water molecule (R2) with Ar* for generating $H_3O^+$ and $O_2^-$ occur "continuously to some degree". In order to cause the penning ionization of a water molecule to occur, a "considerable amount" of Ar* enabling the occurrence of the penning ionization of a water molecule, that is, electrons each having a kinetic energy of 15.6 eV or more are required. Therefore, it is necessary to ensure a tip end surface region of the needle electrode 19 capable of generating the electrons each having a kinetic energy of 15.6 eV or more in the "considerable amount". That is, an electric field in a dark-discharge current range (=electric field that is relatively high and limited in the dark-discharge current range) enabling the foregoing is used.

Next, experimental results obtained by subjecting a sample to mass spectrometry for confirming the action of the atmospheric pressure ionization method through use of a plurality of needle electrodes having different tip end radii of curvature, each including a tip end formed into a two-sheeted hyperboloid of revolution, are shown in a graph, and the action of the present invention is exemplified.

In this experiment, the distance between the needle electrode 19 and the opposing electrode 23 is 15 mm, and the tip end portion 19*a* of the needle electrode 19 has an angle of 90° with respect to the opposing electrode 23 (=the center axis S of the needle electrode 19 is perpendicular to the opposing electrode 23). In this experiment, the total ion amount of background ions derived from respective components in the atmosphere, which were generated when the plurality of needle electrodes 19 having different tip end radii of curvature were used, was measured in a positive ion mode through use of an ion trap type mass spectrometer.

Experiment 1

The needle electrode 19 having a tip end radius of curvature of 1 μm, the electrode including a tip end formed into a two-sheeted hyperboloid of revolution, was used.

Figure 5:
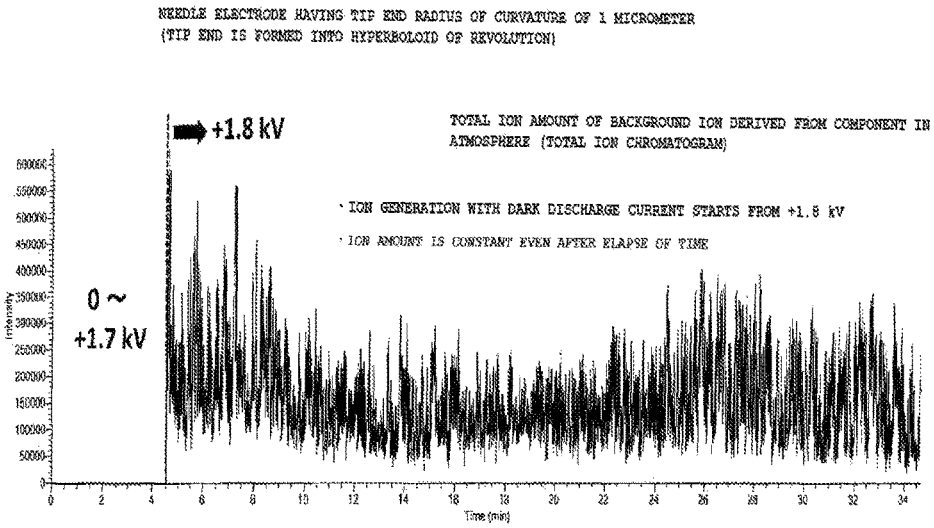
FIG. 5 is a graph for showing results of Experiment 1 in which mass spectrometry of a sample for confirming the action of the atmospheric pressure ionization method according to the present invention was performed.

The experimental results are as described below. As shown in FIG. 5, ions were not detected until the voltage applied to the needle electrode 19 reached 1.7 kV. After the application voltage reached 1.8 kV, ions were detected while a dark discharge current was kept, and the intensity thereof did not change even after an elapse of 30 minutes. It was confirmed from a mass spectrum that generated ion species also did not change.

Further, the shape of the tip end of the needle electrode 19 did not change even after an elapse of 30 minutes.

Experiment 2

The needle electrode 19 having a tip end radius of curvature of 25 μm, the electrode including a tip end formed into a two-sheeted hyperboloid of revolution, was used.

Figure 6:
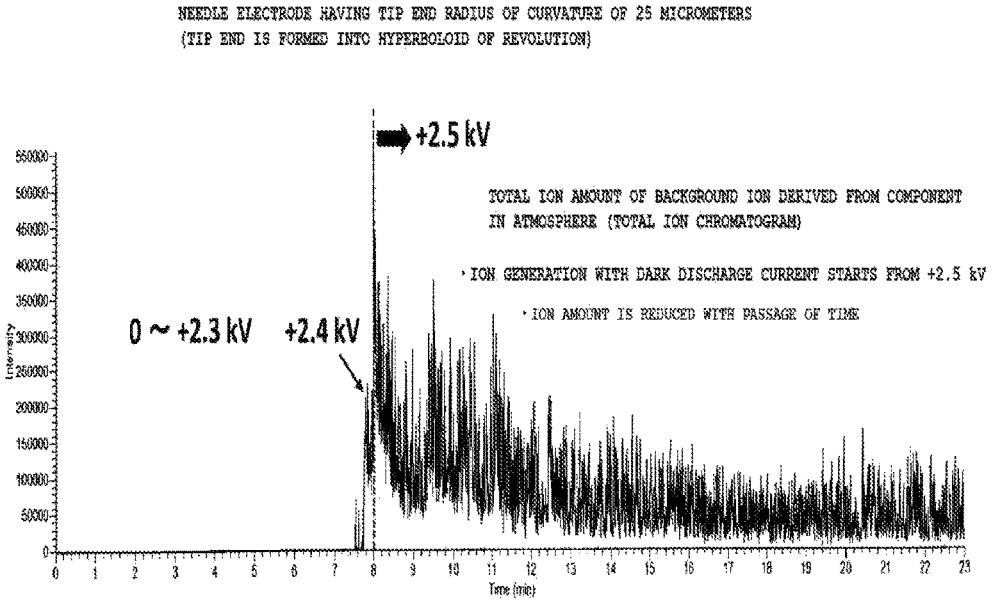
FIG. 6 is a graph for showing results of Experiment 2 in which mass spectrometry of a sample for confirming the action of the atmospheric pressure ionization method according to the present invention was performed.

The experimental results are as described below. As shown in FIG. 6, ions were not detected until the voltage applied to the needle electrode 19 reached 2.3 kV. After the application voltage reached from 2.4 kV to 2.5 kV, ions were detected while a dark discharge current was kept. However, the ion amount thereof was about ¼ of that in the case of using the needle electrode 19 having a tip end radius of curvature of 1 μm.

Thus, the voltage at which the ions start being detected is higher in the above-mentioned needle electrode 19 than in the needle electrode 19 having a tip end radius of curvature of 1 μm. The reason for this is that, owing to the large tip end radius of curvature, the intensity of the electric field generated on the tip end surface of the needle electrode 19 is low as a whole. This means that a higher voltage is required.

Experiment 3

The needle electrode 19 having a tip end radius of curvature of more than 30 μm, the electrode including a tip end formed into a two-sheeted hyperboloid of revolution, was used.

Figure 7:
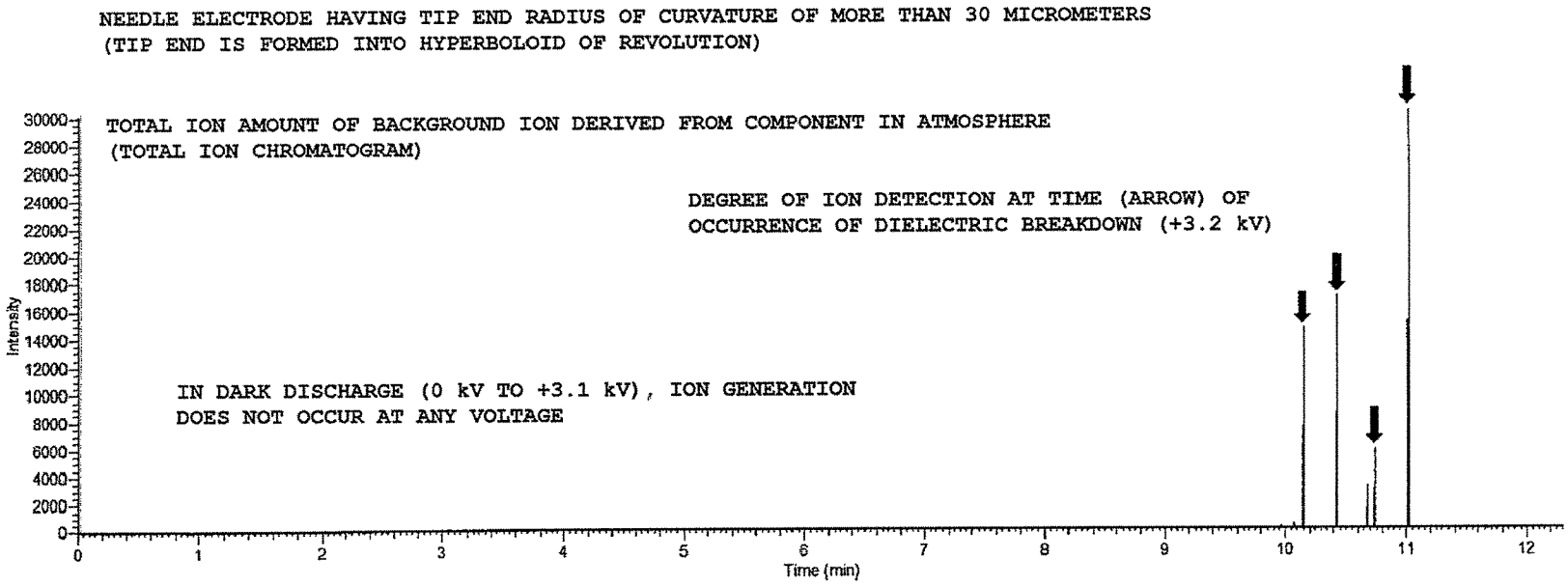
FIG. 7 is a graph for showing results of Experiment 3 in which mass spectrometry of a sample for confirming the action of the atmospheric pressure ionization method according to the present invention was performed.

The experimental results are as described below. As shown in FIG. 7, even when a voltage was increased, ions were not detected in a dark-discharge current range. The reason for this is as described below. The tip end radius of curvature is too large, and hence in the dark-discharge current range, it is impossible to ensure a region of the tip end portion 19*a* of the needle electrode 19 capable of generating: the excited argon gas in the "certain amount" or more capable of generating an ion amount that can be observed with the mass spectrometer; and electrons each having a kinetic energy of 15.6 eV or more. Only when discontinuous dielectric breakdown involving an emission phenomenon occurred beyond the dark-discharge current range, ions were detected in a spike shape.

Experiment 4

Figure 9:
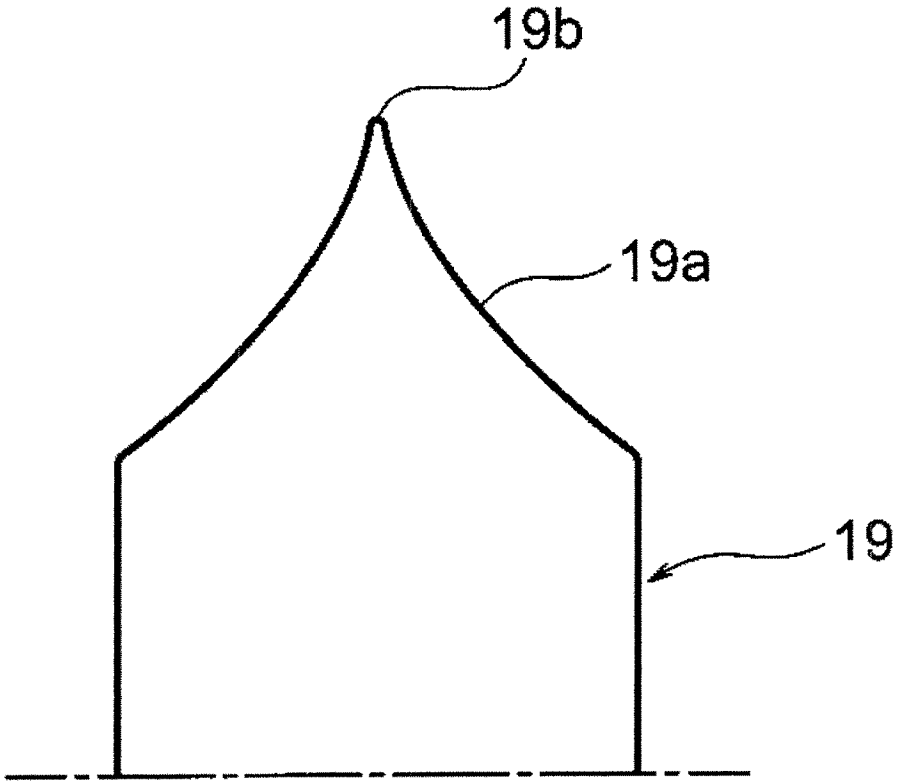
FIG. 9 is an enlarged view for illustrating a tip end portion of a needle electrode used in Experiment 4.

The needle electrode 19 having a tip end radius of curvature of less than 1 μm, the electrode including a tip end formed into a reversed curved surface, was used (see FIG. 9).

Figure 8:
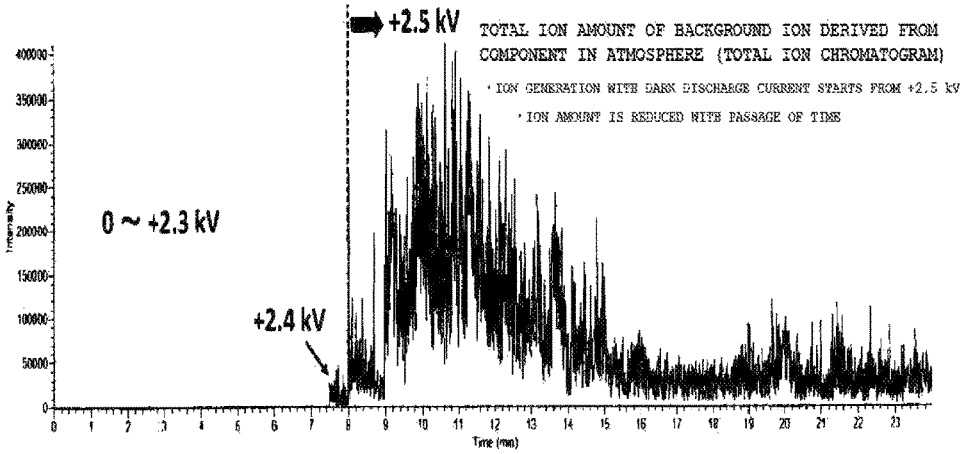
FIG. 8 is a graph for showing results of Experiment 4 in which mass spectrometry of a sample for confirming the action of the atmospheric pressure ionization method according to the present invention was performed.

The experimental results are as described below. As shown in FIG. 8, ions were not detected until the voltage applied to the needle electrode 19 reached 2.3 kV. After the application voltage reached from 2.4 kV to 2.5 kV, ions were detected while a dark discharge current was kept. However, the total ion amount significantly reduced after an elapse of about 5 minutes, and the ion amount thereof was about ⅕ of that in the case of using the needle electrode 19 having a tip end radius of curvature of 1 μm.

The reason for this is as described below. The tip end radius of curvature is too small, and hence the shape of the tip end surface changes with the passage of time, with the result that an electric field generated on the tip end surface (electric field intensity) cannot be kept constant. Further, the voltage at which the ions start being detected is higher in the above-mentioned needle electrode 19 than in the needle electrode 19 having a tip end radius of curvature of 1 μm. The reason for this is as described below. In the case of the reversed curved surface, only the tip end radius of curvature is excessively small. As a result, the radius of curvature of the periphery of the most tip end increases sharply. Therefore, in order to ensure a region of the tip end portion 19*a* of the needle electrode 19 capable of generating the electrons each having a kinetic energy of 15.6 eV or more in the "certain amount" or more required for mass spectrometry, larger electric power is required.

Next, experimental results obtained by measuring the absolute intensities of ions derived from tryptophan (molecular weight: 204) that is a kind of amino acid under various discharge conditions for confirming the action of the atmospheric pressure ionization method through use of the needle electrode 19 having a tip end radius of curvature of 1 μm, the electrode including a tip end formed into a two-sheeted hyperboloid of revolution, are shown in a graph.

In this experiment, the distance between the needle electrode 19 and the opposing electrode 23 is 15 mm, and the tip end portion 19*a* of the needle electrode 19 has an angle of 90° with respect to the opposing electrode 23 (=the center axis S of the needle electrode 19 is perpendicular to the opposing electrode 23). In this experiment, the absolute intensity of ions derived from tryptophan was measured in a positive ion mode through use of an ion trap type mass spectrometer.

Experiment 5

Figure 10:
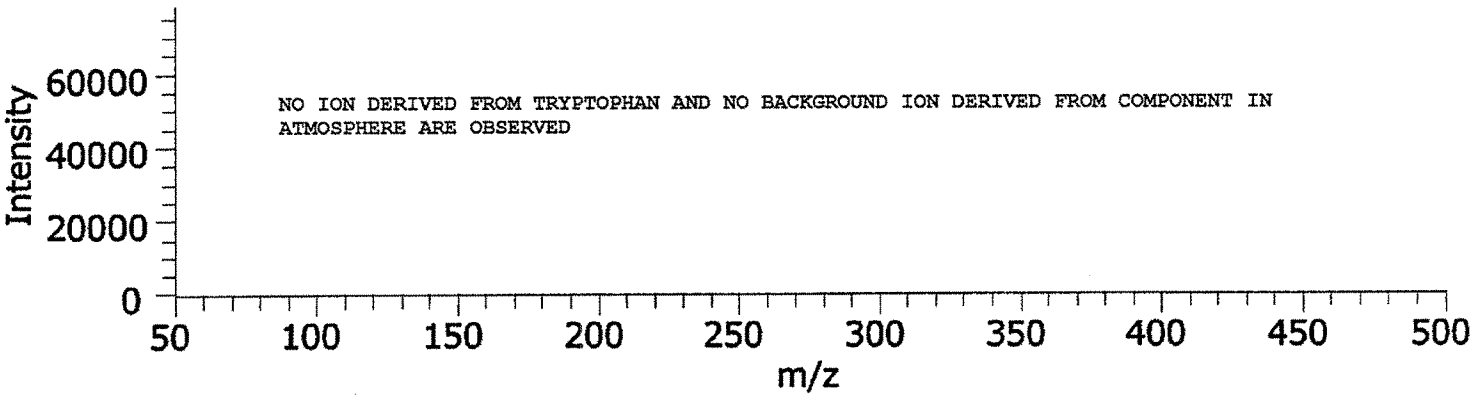
FIG. 10 is a graph for showing results of Experiment 5 in which absolute intensity of the ion originating in tryptophan (molecular weight: 204) that was a kind of amino acid was measured under a predetermined discharge condition for confirming the action of the atmospheric pressure ionization method according to the present invention through use of a needle electrode including a tip end formed into a two-sheeted hyperboloid of revolution and having a tip end radius of curvature of 1 μm.

The experimental results are as described below. As shown in FIG. 10, ions derived from tryptophan and background ions derived from components in the atmosphere are not detected at a time of a low electric field (1.0 kV) in a dark-discharge current range caused by the argon gas. The reason for this is as described below. The electric field is too low, and hence it is impossible to ensure a region of the tip end portion 19*a* of the needle electrode 19 capable of generating: the excited argon gas in the "certain amount" or more capable of generating an ion amount that can be observed with the mass spectrometer; and the electrons each having a kinetic energy of 15.6 eV or more.

Experiment 6

Figure 11:
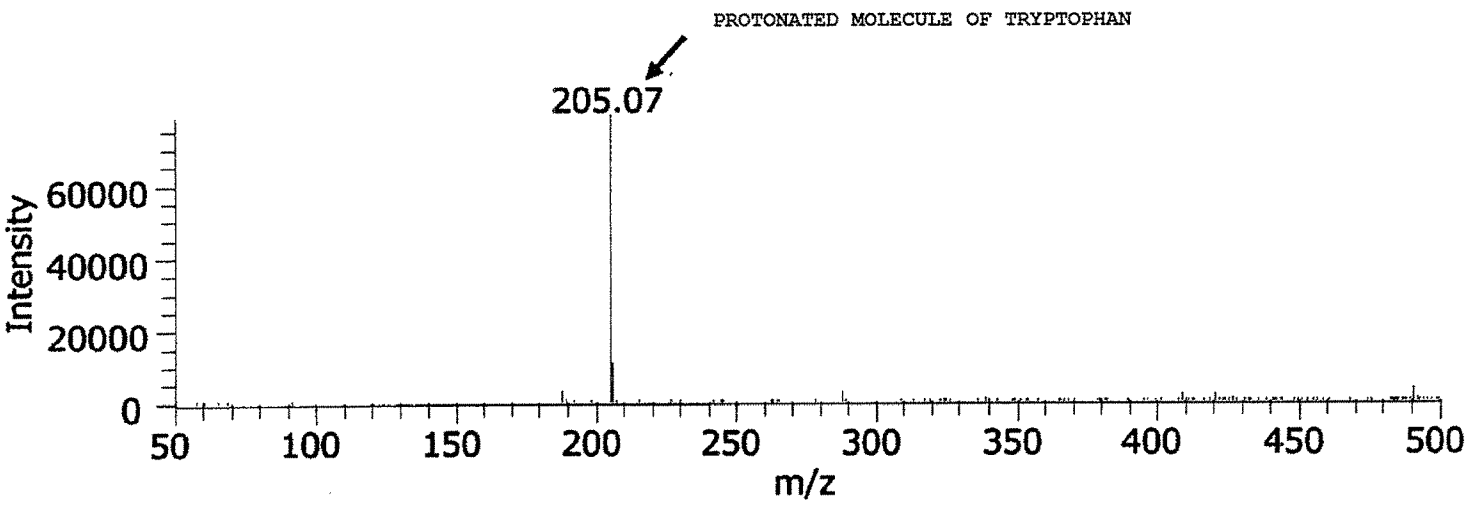
FIG. 11 is a graph for showing results of Experiment 6 in which absolute intensity of the ion originating in tryptophan (molecular weight: 204) that was a kind of amino acid was measured under a predetermined discharge condition for confirming the action of the atmospheric pressure ionization method according to the present invention through use of a needle electrode including a tip end formed into a two-sheeted hyperboloid of revolution and having a tip end radius of curvature of 1 μm.

The experimental results are as described below. As shown in FIG. 11, a protonated molecule (m/z: 205.07) of tryptophan is observed with an extremely high intensity at a time of a high electric field (2.5 kV) in a dark-discharge current range caused by the argon gas. Tryptophan is known to be a sample highly liable to be oxidized (that is, oxygen adduct ions are liable to be generated) (in continuous discharge using the excited helium gas, oxygen adduct ions are detected in a large amount). In the case of using the present invention, by-products, such as oxygen adduct ions, other than the protonated molecule are not detected. Even when this discharge is continued, the shape of the tip end of the needle electrode 19 does not change, and the protonated molecule of the sample can be detected with good sensitivity for a long time period (for example, 30 minutes).

Experiment 7

Figure 12:
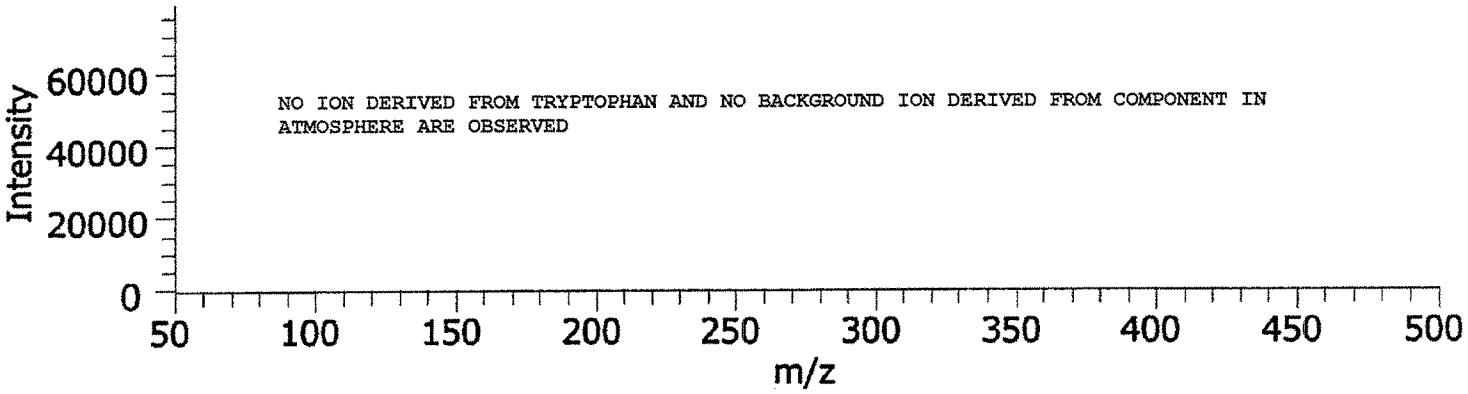
FIG. 12 is a graph for showing results of Experiment 7 in which absolute intensity of the ion originating in tryptophan (molecular weight: 204) that was a kind of amino acid was measured under a predetermined discharge condition for confirming the action of the atmospheric pressure ionization method according to the present invention through use of a needle electrode including a tip end formed into a two-sheeted hyperboloid of revolution and having a tip end radius of curvature of 1 μm.

The experimental results are as described below. As shown in FIG. 12, at a time of continuous discharge (5.5 kV) caused by the argon gas, the generation of ions is extremely unstable and causes much noise, and ions derived from the sample cannot be detected. The reason for this is considered to be described below. The shape of the tip end of the needle electrode 19 changes with the passage of time at a time of continuous discharge, and hence a stable electric field (electric field intensity) is not continuously generated on the tip end surface of the needle electrode 19.

REFERENCE SIGNS LIST

1 ionization apparatus
2 mass spectrometer
3 analysis chamber
4 first intermediate vacuum chamber
5 second intermediate vacuum chamber
6 ion introduction pipe
7 skimmer
8, 9 ion guide
10 mass separation unit
11 ion detector
12 data processing unit
13 power source unit
14 analysis control unit
15 input unit
16 display unit
17 sample holder
18 sample drive mechanism
19 needle electrode
19*a* tip end portion of needle electrode
19*b* most tip end of needle electrode
20 needle electrode support mechanism
21 needle electrode position drive unit
22 voltage generation unit
23 opposing electrode
24 gas outlet nozzle
25 gas heating mechanism
26 gas flow passage control unit
27 gas introduction pipe
28 X-Y axis drive mechanism
29 Z-axis drive mechanism
30 tilting mechanism
A sample
C ion optical axis
S center axis of needle electrode

The invention claimed is:

1. An atmospheric pressure ionization method for ionizing a sample by applying a voltage to a needle electrode to cause discharge, causing an inert gas to flow into a discharge zone to excite the inert gas, and by causing the excited inert gas and the sample to react with each other, the atmospheric pressure ionization method using an argon gas as the inert gas and using: a gas flow passage control unit and a gas outlet nozzle configured to jet the argon gas to an atmospheric atmosphere at a predetermined flow rate and a predetermined temperature; a needle electrode that is arranged between an outlet port of the gas outlet nozzle and an introduction port of an ion introduction pipe configured to introduce an ion, and that includes a tip end portion formed into a two-sheeted hyperboloid of revolution having a radius of curvature of 1 μm or more and less than 30 μm; a needle electrode support mechanism configured to adjust a relative position or a relative angle of the needle electrode with respect to a center axis of the gas outlet nozzle; and a voltage generation unit configured to apply a voltage to the needle electrode, the atmospheric pressure ionization method comprising:

applying a voltage of 1.8 kV or more to the needle electrode from the voltage generation unit to generate a dark discharge;

exciting the argon gas with a dark discharge current; and causing the excited argon gas and the sample to react with each other, to thereby ionize the sample.

* * * * *